US008430698B2

(12) United States Patent
Stewart et al.

(10) Patent No.: US 8,430,698 B2
(45) **Date of Patent: *Apr. 30, 2013**

(54) ELECTRICAL TERMINAL WITH COIL SPRING

(75) Inventors: Robert A. Stewart, South Lyon, MI (US); Slobodan Pavlovic, Novi, MI (US); Michael Glick, Farmington Hills, MI (US); David Menzies, Linden, MI (US); Cecil Lamar Brown, II, Canton, MI (US)

(73) Assignee: Lear Corporation, Southfield, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/599,306

(22) Filed: Aug. 30, 2012

(65) Prior Publication Data

US 2012/0322322 A1 Dec. 20, 2012

Related U.S. Application Data

(63) Continuation of application No. 13/073,478, filed on Mar. 28, 2011, now Pat. No. 8,282, 429.

(60) Provisional application No. 61/364,921, filed on Jul. 16, 2010, provisional application No. 61/360,938, filed on Jul. 2, 2010.

(51) Int. Cl.
*H01R 13/187* (2006.01)

(52) U.S. Cl.
USPC ..... 439/843

(58) Field of Classification Search ..... 439/843, 439/846, 851, 884, 825
See application file for complete search history.

(56) References Cited

U.S. PATENT DOCUMENTS

| | | | | |
|---|---|---|---|---|
| 2,912,668 | A | 11/1959 | Eddy | |
| 4,714,441 | A | 12/1987 | Corman | |
| 4,826,144 | A | 5/1989 | Balsells | |
| 5,139,276 | A | 8/1992 | Balsells | |
| 5,358,224 | A * | 10/1994 | Balsells | 267/33 |
| 5,474,309 | A | 12/1995 | Balsells | |
| 5,599,027 | A | 2/1997 | Balsells | |
| 5,730,628 | A | 3/1998 | Hawkins | |
| 6,042,432 | A | 3/2000 | Hashizawa et al. | |
| 6,190,215 | B1 | 2/2001 | Pendleton et al. | |
| 6,254,439 | B1 | 7/2001 | Endo et al. | |

(Continued)

FOREIGN PATENT DOCUMENTS

| | | |
|---|---|---|
| CH | 151479 | 3/1932 |
| DE | 19836196 A1 | 2/1999 |
| DE | 19943373 A1 | 3/2000 |

(Continued)

OTHER PUBLICATIONS

German Office Action for corresponding Application No. 10 2011 078 343.1, mailed Apr. 24, 2012, 4 pages.

*Primary Examiner* — Tulsidas C Patel
*Assistant Examiner* — Phuongchi Nguyen
(74) *Attorney, Agent, or Firm* — Brooks Kushman P.C.

(57) ABSTRACT

An electrical terminal is operable to facilitate electrical connectivity between the terminal and an electrical connector. The electrical terminal may include a cap to facilitate positioning a conducting element, such as but not limited to a coil spring, within a receptacle used to connect to an electrically conducting connector. The conducting element may facilitate electrical connectivity between the inserted connector and the terminal.

20 Claims, 2 Drawing Sheets

U.S. PATENT DOCUMENTS

| | | | | |
|---|---|---|---|---|
| 6,835,084 | B2 | 12/2004 | Poon et al. | |
| 6,848,922 | B2 | 2/2005 | Coughlan et al. | |
| 7,697,989 | B1 * | 4/2010 | Lim et al. | 607/36 |
| 7,822,477 | B2 * | 10/2010 | Rey et al. | 607/37 |
| 7,828,609 | B2 | 11/2010 | Li et al. | |
| 7,909,236 | B2 | 3/2011 | Erdie | |
| 2004/0245686 | A1 | 12/2004 | Balsells | |
| 2005/0242910 | A1 | 11/2005 | Balsells | |
| 2008/0246231 | A1 | 10/2008 | Sjostedt et al. | |
| 2008/0254670 | A1 | 10/2008 | Balsells et al. | |
| 2008/0255631 | A1 | 10/2008 | Sjostedt et al. | |
| 2009/0048638 | A1 | 2/2009 | Rey et al. | |
| 2009/0258519 | A1 | 10/2009 | Dilmaghanian et al. | |
| 2010/0029127 | A1 * | 2/2010 | Sjostedt | 439/346 |
| 2010/0029145 | A1 * | 2/2010 | Balsells et al. | 439/827 |
| 2010/0279558 | A1 | 11/2010 | Leon et al. | |

FOREIGN PATENT DOCUMENTS

| | | | |
|---|---|---|---|
| DE | 102004002403 | B3 | 7/2005 |
| FR | 997233 | | 9/1951 |
| JP | 2007317403 | A | 12/2007 |

* cited by examiner

ELECTRICAL TERMINAL WITH COIL SPRING

CROSS-REFERENCE TO RELATED APPLICATIONS

This application is a continuation of U.S. application Ser. No. 13/073,478 filed Mar. 28, 2011, now U.S. Pat. No. 8,282,429 B2, which, in turn, claims the benefit of U.S. provisional Application No. 61/364,921 filed Jul. 16, 2010, and U.S. provisional Application No. 61/360,938 filed Jul. 2, 2010, the disclosures of which are incorporated in their entirety by reference herein.

TECHNICAL FIELD

The present invention relates to electrical terminals, such as but not limited to terminals of the type having coils springs operable to facilitate electrical connectivity between the terminal and an electrical connector.

BACKGROUND

Electrical terminals are used in a number of applications to facilitate electrical connecting one element to another. Some electrical terminals may be configured to facilitate use with a removable connector in that the connector may be repeatedly inserted and removed or otherwise configured to repeatedly engage and disengage the electrical terminal. The ability of the electrical terminal to facilitate electrical connectivity with such a removable connector can be problematic if an electrical connection area between the terminal and connector has poor connectivity, particularly when tolerance variations or degradation from repeated use causes a mating arrangement between the components to become loose or otherwise insecure.

SUMMARY

According to at least one embodiment, an electrical terminal is provided with an electrically conducting body having a recessed end. The recessed end has a first portion with a first width. A resilient conducting element is positioned within the first recessed end. The conducting element has a first opening with a second width to provide an interference fit with a connector received within the resilient conducting element to electrically connect the connector to the electrically conducting body. An end cap is positioned within the first recessed end outboard of the resilient conducting element to secure the resilient conducting element within the recessed end.

According to at least one embodiment, an electrical terminal is provided with a body portion having a first cylindrical receptacle defining a first opening for receiving a first connector. The first cylindrical receptacle is inward of the first opening and has a cross-hole to an exterior of the body portion. The first cylindrical receptacle is closed inward of the first opening such that the cross-hole provides the only opening inward of the first opening to the exterior of the body portion. A coil spring is positioned within the first cylindrical receptacle. The coil spring is configured to facilitate electrical connectivity between the body portion and the first connector.

According to at least one embodiment, an electrical terminal for electrically connecting to a connector is provided with an elongated body having an opening at one end for receiving the connector and an end wall with a blind depth at an opposite end. The elongated body defines an interior cavity between the opening and the end wall, wherein the end wall is coaxial with the opening. A spring is positioned within the open end and is configured to facilitate electrical connectivity between the body portion and the connector. A flanged cap is inserted within the open end to secure the coil spring to the body portion. The flanged cap has a first portion positioned within the open end to secure the spring and a second portion positioned exterior to the open end.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
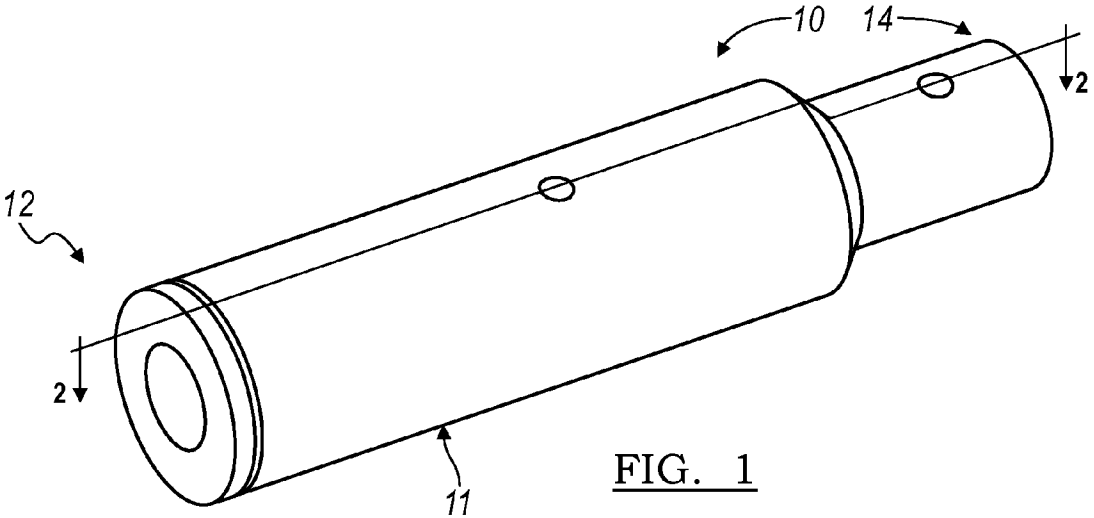
FIG. 1 illustrates an electrical terminal contemplated by one non-limiting aspect of the present invention.
Figure 2:
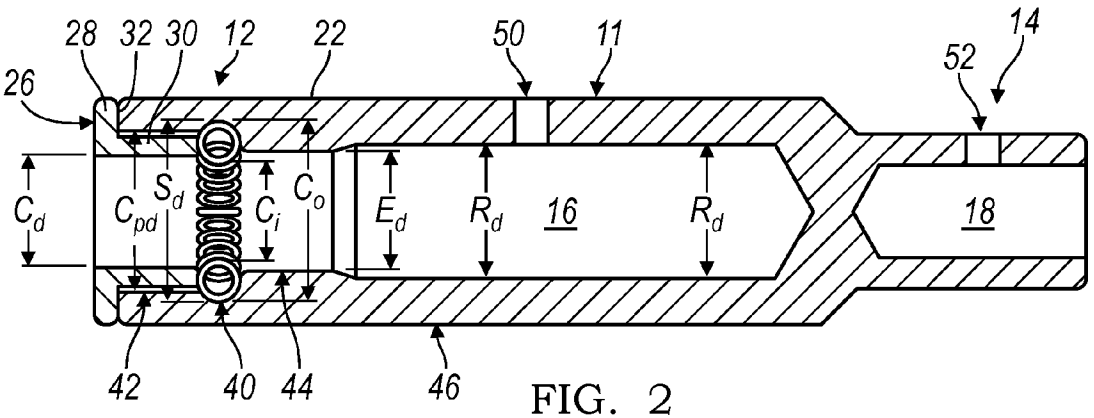
FIG. 2 illustrates a cross-sectional view of the electrical terminal taken along line 2-2 of FIG. 1.

FIG. 1 illustrates an electrical terminal 10 contemplated by one non-limiting aspect of the present invention. FIG. 2 illustrates a cross-sectional view of the electrical terminal 10 taken along line 2-2. The electrical terminal 10 may be configured in accordance with the present invention to facilitate electrically interconnecting first and second connectors (not shown), such as but not limited to one being a high current terminal suitable for use in hybrid electric vehicle charge couplers, optionally conforming to the Society of Automotive Engineers (SAE) standard SAE J1772. The electrical terminal 10 may be comprised of a conducting material body 11 having integrally formed first and second ends 12, 14 configured to facilitate respectively establishing a removable electrical connection with the first and second connectors. The electrical terminal 10 may be formed through a machining operation or other suitable manufacturing process to include a first bored or open end 16 and a second bored or opened end 18.

The bored ends 16, 18 are shown to be cylindrically shaped to facilitate generating an interference fit with a corresponding shaped portion of the first and second connectors. The terminal 10 and bored ends 16, 18, however, are not intended to be limited to being cylindrically shaped and may be shaped into any other suitable geometry. The second end 14, optionally, may be formed with another connection feature instead of the illustrated bored end 18, such as but not limited being formed as a solid and/or deformable material that may be welded, affixed, or otherwise connected to the connecting element, including being shaped as male terminal used for insertion into a mating female terminal. As such, the description herein sets forth the illustrated embodiment for exemplary purposes only and without intending to unnecessary limit the scope and contemplation of the present invention.

A conducting element 22 may provide the body portion 11. Another conducting element 40 may be positioned within the first bored end 16 to facilitate electrical interconnection with the body portion 11. The conducting element 40 is shown to be a coil spring 40 but may comprise any suitably sized and shaped conducting element 40 operable to facilitate establishing and/or enhancing the electrical interconnection between the body 11 and the first connector. Other such conducting elements may include a conducting elastomer having suspending micro-wires, braided element, etc. The exemplary coil spring 40 is shown to be tubular in shape with an inner diameter $C_i$ and an outer diameter $C_o$. The coil spring 40 may be comprised of any suitably conducting material and/or resilient material capable of flexing during connector insertion and thereafter unflexing when the connector is removed. The resiliency of the coil spring 40 may be beneficial in preventing tolerance variations or degradation from repeated use from causing the electrical connection between the body 11 and the first connector to become loose or otherwise insecure A cap 26 may be inserted at an outward side of the coil spring 40 to secure the coil spring 40 within the body 11. The cap 26 may include a flange 28 and a tubular shaped body portion 30. The flange 28 overlaps the bored end 16 to limit an insertion distance of the tubular shaped body portion 30. A length of the body portion 30 may be selected to facilitate positioning of the coil spring 40. This may include selecting the length so that the spring 40 is compressed when the cap 26 is properly inserted, such as to cause the inner spring diameter $C_i$ to narrow in order to match a differently sized first connector and/or to increase insertion/retaining forces on the first connector. The length may also be selected to prevent compression of the spring 40 while, optionally, at the same time allowing the tubular portion 30 to slightly contact the spring 40 so that it can be desirably positioned within the bored end 16.

The cap 26 may be removably connected to the bored end 16, such as with an interference fit, or more permanently connected, such as with fusing welding or other suitable welding. The welding, optionally, may be limited to an area between the flanged portion 28 and an outer end 32 of the body portion 11, which may be beneficial in preventing the welding from limiting a closeness of fit between the tubular body 30 and the bored end 16, as some designs may be relatively intolerant to tolerance variations that could otherwise result from a welding operation. Advantageously, one cap 26 may be switched with another cap 26 having different dimensional features, such as to change a diameter $C_d$ of a through-hole in order to vary insertion/retaining forces on the first connector.

The cap 26 and coils spring 40 may be positioned with a passageway defined by the bored end 16. The passageway may include the coil spring portion 40, cap portion 42, an engagement portion 44, and a relief portion 46, and optionally, cross-holes 50, 52 may be provided to prevent pressure build up during connector insertion.

The relief portion 46 may have a diameter/width $R_d$ sufficient to permit a leading end of the first connector to move laterally during insertion, which may be helpful in limiting some of the insertion forces. The engagement portion 44 may have a diameter/width $E_d$ sufficient to generate an interference fit with the first connector. The diameter $E_d$ of the engagement portion 44 may be slightly less than the diameter $R_d$ of the relief portion 46. The coil portion 40 may have a diameter/width $S_d$ sized relative to the outer and inner diameters $C_o$, $C_i$ of the coil spring 40 to facilitate positioning the coil spring 40 relative to the first connector in a manner that facilitates the desired electrical interconnection with the body 11 without requiring an undesirable amount of force to insert the connector. The diameter $S_d$ of the coil spring portion 40 may be slightly larger than the diameter $E_d$ of the engagement portion 44. The cap portion 42 may have a diameter $C_{pd}$ sized relative to the tubular shaped portion 30 of the cap 26, which, as shown, is slightly smaller than the diameter $S_d$ of the coil portion 40. This may be helpful in forming a small recess to facilitate initially position the coil spring 40 prior to insertion of the cap 26, which also may require a slight compression of the spring 40 during insertion. The coil spring portion 40 may, however, have the same diameter $S_d$ of the coil spring portion 40 so that the coil spring portion 40 needs to be machined as a groove or slot.

Figure 3:
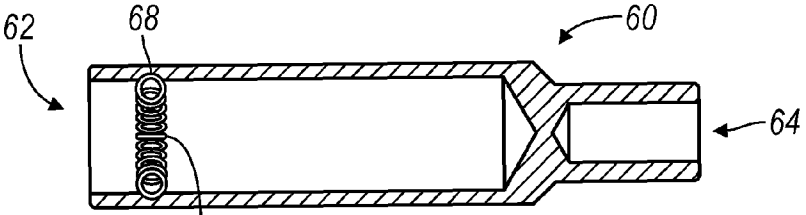
FIG. 3 illustrates a capless terminal in accordance with one non-limiting aspect of the present invention.

FIG. 3 illustrates a capless terminal 60 machined from a single piece of material in accordance with one non-limiting aspect of the present invention. The terminal has an open end 62, a wire connection end 64, and an internal spring 66. The internal spring 66 used in the terminal 60 must be compressed and inserted through the open end 64 of the terminal 60, and seated in a milled slot or groove 68 within the terminal 60. The position of the internal spring 66 may be sufficient to retain the spring 66 within the open end 64 without the use of the cap 26 described above with respect to FIGS. 1-2.

The machining of the capless terminal 60, especially the groove 68, can be problematic. It may be desirable to guide or otherwise facilitate insertion of a pin or other element connector inserted into the open end 64, such as to facilitate its alignment with the terminal 60 and to limit its contact with the spring 66. This can be accomplished by position the groove farther away from an entrance to the open end 64 but it is also problematic since it makes machining the groove 68 more difficult. While the difficulty of machining such an inward groove can be decreased by increasing a diameter of the open end 64, this too is problematic since a larger entrance potentially exposing the spring to fatigue or damage during pin insertion. The caped design noted above and the other capped design noted below are believed to provide an easier machining process that allows the groove 68 to be positioned farther inward without having to correspondingly increase an entrance diameter of the open end 64.

Figure 5:
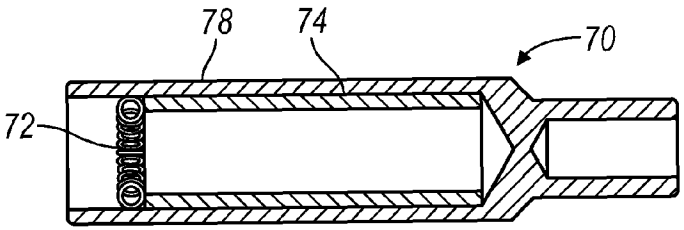
FIGS. 4-6 illustrate a tubed terminal in accordance with one non-limiting aspect of the present invention.
Figure 4:
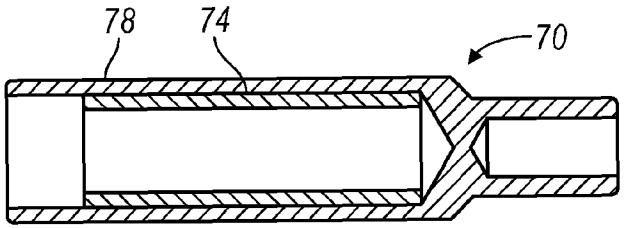
Figure 6:
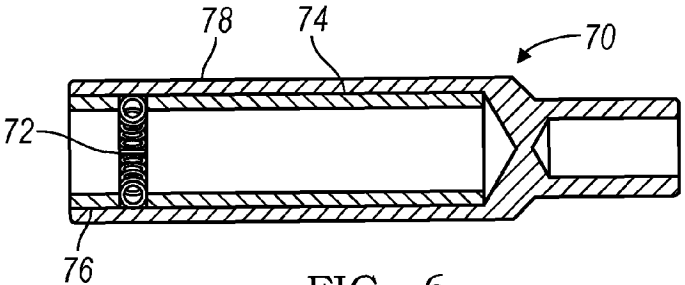

FIGS. 4-6 illustrate a tubed terminal 70 in accordance with one non-limiting aspect of the present invention. As seen therein, the terminal 70 may be assembled without machining a slot for an internal spring 72 by using a series of interference fit tubes 74, 76. The first tube 74 is positioned within a uniformly through-hole bored terminal body 78. Another tube 76 may be thereafter pressed into the terminal body 78. The internal spring may be inserted or dropped into the subassembly formed by the terminal body 78 and the tube 74, optionally without being compressed to fit within the body 78. The tube 76 may be inserted into the terminal body 78, acting as a cap to capture the spring. A swage or other mechanical method may be used to secure the cap 76.

As supported above, terminals protection for the spring or other conducting in a manner that extends the life of the receptacle/connector by allowing for easy assembly of the spring to the receptacle. The terminals contemplated by the present invention may also make it easier to properly plate the internal, functional area of the terminal for proper electrical operation, and help reduce the costs associated with machining the receptacle.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrical terminal comprising:

an electrically conducting body having a recessed end, the recessed end having a first portion with a first width;

a resilient conducting element positioned within the first recessed end, the conducting element having a first opening with a second width to provide an interference fit with a connector received within the resilient conducting element to electrically connect the connector to the electrically conducting body; and an end cap positioned within the first recessed end outboard of the resilient conducting element to secure the resilient conducting element within the recessed end.

2. The terminal of claim 1 wherein the first width is greater than the second width and the second width is less than a width of the connector.

3. The terminal of claim 1 wherein the end cap is comprised of a conducting material and is welded to the recessed end.

4. The terminal of claim 1 wherein the conducting element comprises a coil spring.

5. The terminal of claim 4 wherein the cap is configured to compress the coil spring.

6. The terminal of claim 4 wherein the cap is configured to contact the coil spring without compressing the coil spring.

7. The terminal of claim 1 wherein the first portion is further defined as an engagement portion configured to provide an interference fit with the connector.

8. The terminal of claim 7 wherein the first recessed end includes a relief positioned inward of the first engagement portion, the relief configured to enable insertion of the connector and having a seventh width that is greater than the first width.

9. The terminal of claim 7 wherein the electrically conducting body includes a second recessed end being formed integral with the first recessed end, the second recessed having a second engagement portion shaped to provide an interference fit with a second connector to be inserted therein.

10. The terminal of claim 7 wherein the first engagement portion is formed by an interior portion of a first tube positioned within the first recessed end.

11. The terminal of claim 10 wherein the cap is formed by a second tube positioned within the first recessed end on a side of the conducting element opposite of the first tube.

12. The terminal of claim 1 wherein the end cap has a second opening with a third width sized to provide an interference fit with the connector, the connector passing through the second opening to be received within the first opening.

13. The terminal of claim 12 wherein the third width is approximately equal to a width of the connector and wherein the third width is greater than the second width.

14. The terminal of claim 13 wherein the first width is greater than the third width.

15. The terminal of claim 12 wherein the first recessed end is configured to receive at least a first portion of the cap, an exterior portion of the first portion having a fourth width, the fourth width being greater than the first width.

16. The terminal of claim 15 wherein each of the first, second, third, and fourth widths are diameters.

17. The terminal of claim 15 wherein the cap includes at least a second portion outboard of the first recessed end, an exterior portion of the second portion having a fifth width that is greater than the fourth width.

18. The terminal of claim 17 wherein an exterior portion of the electrically conducting body has a sixth width that is approximately equal to the fifth width.

19. An electrical terminal comprising:

a body portion having a first cylindrical receptacle defining a first opening for receiving a first connector, the first cylindrical receptacle being inward of the first opening having a cross-hole to an exterior of the body portion, the first cylindrical receptacle being closed inward of the first opening such that the cross-hole provides the only opening inward of the first opening to the exterior of the body portion; and a coil spring positioned within the first cylindrical receptacle, the coil spring being configured to facilitate electrical connectivity between the body portion and the first connector.

20. An electrical terminal for electrically connecting to a connector comprising:

an elongated body having an opening at one end for receiving the connector and an end wall with a blind depth at an opposite end, the elongated body defining an interior cavity between the opening and the end wall, wherein the end wall is coaxial with the opening;

a spring positioned within the open end configured to facilitate electrical connectivity between the body portion and the connector; and a flanged cap inserted within the open end to secure the coil spring to the body portion, the flanged cap having a first portion positioned within the open end to secure the spring and a second portion positioned exterior to the open end.

* * * * *

UNITED STATES PATENT AND TRADEMARK OFFICE

CERTIFICATE OF CORRECTION

PATENT NO. : 8,430,698 B2
APPLICATION NO. : 13/599306
DATED : April 30, 2013
INVENTOR(S) : Robert A. Stewart et al.

It is certified that error appears in the above-identified patent and that said Letters Patent is hereby corrected as shown below:

In the Claims:

Column 5, Line 41, Claim 9:

After "second recessed" insert -- end --.

Signed and Sealed this
Twenty-fourth Day of September, 2013

Teresa Stanek Rea
*Deputy Director of the United States Patent and Trademark Office*